US010455341B2

(12) United States Patent
Barwicz

(10) Patent No.: US 10,455,341 B2
(45) Date of Patent: Oct. 22, 2019

(54) REMOTE CHECKING OF MICROPHONE CONDITION IN A NOISE MONITORING SYSTEM

(71) Applicant: SVANTEK Sp. z o.o., Warsaw (PL)

(72) Inventor: Wieslaw Barwicz, Warsaw (PL)

(73) Assignee: SVANTEK SP. Z.O.O., Warsaw (PL)

( * ) Notice: Subject to any disclaimer, the term of this patent is extended or adjusted under 35 U.S.C. 154(b) by 0 days.

(21) Appl. No.: 16/231,676

(22) Filed: Dec. 24, 2018

(65) Prior Publication Data

US 2019/0297440 A1 Sep. 26, 2019

(30) Foreign Application Priority Data

Mar. 20, 2018 (EP) ..... 18461538

(51) Int. Cl.
*H04R 29/00* (2006.01)
*H04R 3/00* (2006.01)

(52) U.S. Cl.
CPC ..... *H04R 29/004* (2013.01); *H04R 3/005* (2013.01)

(58) Field of Classification Search
CPC ..... H04R 29/00
See application file for complete search history.

(56) References Cited

U.S. PATENT DOCUMENTS

2002/0034310 A1* 3/2002 Hou ..... H04R 3/005 381/92
2002/0149070 A1* 10/2002 Sheplak ..... G01H 11/08 257/415
2005/0276423 A1 12/2005 Aubauer et al.
2014/0369511 A1* 12/2014 Sheerin ..... H04R 29/004 381/58
2016/0273986 A1* 9/2016 Neubarth ..... G01L 9/0073
2017/0127180 A1* 5/2017 Shields ..... H03G 3/3005

FOREIGN PATENT DOCUMENTS

EP 3223541 9/2017

* cited by examiner

*Primary Examiner* — Olisa Anwah
(74) *Attorney, Agent, or Firm* — Mark M. Friedman

(57) ABSTRACT

A noise monitoring system has at least two microphones and a microphones sensitivity register. The microphones are arranged physically with respect to each other such that when the microphones are placed within an acoustic field to be monitored, the RMS signal level of that acoustic field at each of the microphones is substantially the same for a monitoring frequency range. The microphones sensitivity register has reference data indicative of an initial sensitivity difference ($\Delta_0$) between output RMS signal levels measured by the microphones in a reference acoustic field. A current difference ($\Delta_1$, $\Delta_2$) between the RMS signal levels concurrently output by the microphones for the currently monitored acoustic field is compared. A fault signal is generated if the current difference ($\Delta_1$, $\Delta_2$) differs from the initial sensitivity difference ($\Delta_0$) more than an acceptable limit.

8 Claims, 3 Drawing Sheets

REMOTE CHECKING OF MICROPHONE CONDITION IN A NOISE MONITORING SYSTEM

TECHNICAL FIELD

The present invention relates to remote checking of microphone condition in a noise monitoring system.

BACKGROUND

Outdoor noise monitoring systems are used for long-term measurements of noise, e.g. at roads, airports etc. It is essential to continuously check the accuracy of operation of these systems in order to ascertain that the measurement results are correctly generated. It is preferred if the checking can be performed remotely, without a need for an operator to perform manual procedures at the microphone system. One of the checking procedures is to check whether the system operates according to the initial calibration.

So far, typical outdoor noise monitoring stations used condenser microphones. A condenser microphone can be calibrated by means of an electrostatic actuator that comprises an electrode that permits the application of an electrostatic force to the metallic or metalized diaphragm of the microphone in order to perform the calibration. Alternatively, the equivalent capacitance of the microphone can be measured.

It is also possible to perform acoustic calibration by performing comparison of sound levels received by the measured microphone and a reference microphone. However, as the condenser microphones are relatively large and require high performance preamplifiers, the reference microphone would occupy too much space in the measurement system housing, which must meet strict acoustic requirements. Additionally, such system requires generation of a reference acoustic signal, which makes it hardly applicable in practice.

A US patent application US20140369511 discloses a self calibrating dipole microphone formed from two omni-directional acoustic sensors. The microphone includes a sound source acoustically coupled to the acoustic sensors and a processor. The sound source is excited with a test signal, exposing the acoustic sensors to acoustic calibration signals, which are of the same phase. The responses of the acoustic sensors to the calibration signals are compared by the processor and a correction transfer function is determined. The system is designed in particular for a dipole microphone.

MEMS microphones have been recently developed and find more and more applications of use. So far, little research has been conducted on the possibilities of use of the MEMS microphones for outdoor monitoring systems. MEMS microphones have very small dimensions, which allows designing a multi-microphone system having a housing of standard dimensions used in acoustic fields (for example, a ½" or 1" diameter). However, the MEMS microphones have no equivalent capacitance that could be measured, as in the case of condenser microphones and they cannot be excited by an electrostatic actuator.

A European patent application EP3223541 discloses an outdoor multi-microphone system with an integrated remote acoustic calibration system. The calibration system comprises a reference microphone for measuring ambient sound and a plurality of measurement microphones. In case the levels measured by the reference microphone and the measurement microphones differ by more than a particular threshold, a negative system check result is output.

The prior art solutions for checking microphone systems required interruption of the regular operation of the system in order to perform the system check and use of a dedicated reference microphone in order to perform the system check.

SUMMARY

According to the teachings of an embodiment of the present disclosure, there is provided a method for checking of a microphone condition in a noise monitoring system. The noise monitoring system comprises: at least two microphones arranged physically with respect to each other such that when the microphones are placed within an acoustic field to be monitored, the RMS (root mean square) signal level of that acoustic field at each of the microphones is substantially the same for a monitoring frequency range; and a microphones sensitivity register comprising reference data indicative of an initial sensitivity difference ($\Delta_0$) between output RMS signal levels measured by the microphones in a reference acoustic field. The method comprises: comparing a current difference ($\Delta_1$, $\Delta_2$) between the RMS signal levels concurrently output by the microphones for the currently monitored acoustic field and generating a fault signal if the current difference ($\Delta_1$, $\Delta_2$) differs from the initial sensitivity difference ($\Delta_0$) more than an acceptable limit.

According to a further feature of an embodiment of the present disclosure, two RMS signal levels can be considered to be substantially the same if the difference between the RMS signal levels is lower than the acceptable limit that triggers the fault signal.

According to a further feature of an embodiment of the present disclosure, the differences ($\Delta_0$, $\Delta_1$, $\Delta_2$) between the RMS signal levels can be analyzed for a wide band signal.

According to a further feature of an embodiment of the present disclosure, the differences ($\Delta_0$, $\Delta_1$, $\Delta_2$) between the RMS signal levels can be analyzed individually for a plurality of narrow band signals.

According to a further feature of an embodiment of the present disclosure, the acceptable limit can be defined as a ratio of the current difference ($\Delta_1$, $\Delta_2$) and the initial sensitivity difference ($\Delta_0$).

According to a further feature of an embodiment of the present disclosure, the acceptable limit can be defined as a difference between the current difference ($\Delta_1$, $\Delta_2$) and the initial sensitivity difference ($\Delta_0$).

The present invention is particularly applicable to a microphone system with multiple MEMS microphones, due to the possibility of locating the microphones physically very close to each other, such that all microphones are exposed to the same acoustic field (within the audio frequency band) with a desired accuracy.

BRIEF DESCRIPTION OF DRAWINGS

The solution is presented herein by means of example embodiments on a drawing, in which.

DETAILED DESCRIPTION

Figure 1:
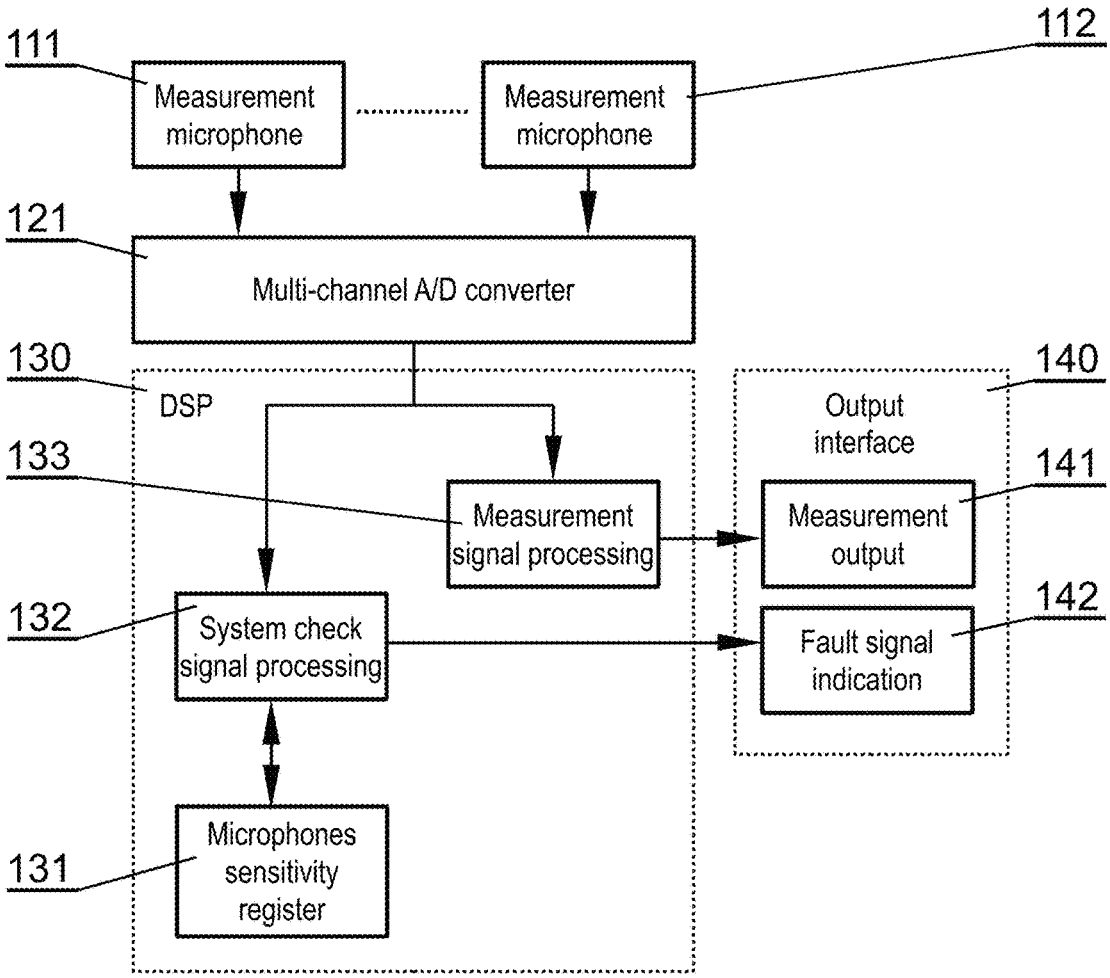
FIG. 1 shows a functional schematic of the microphone system.

A functional schematic of the microphone system for which a dynamic system check can be performed as described herein is shown in FIG. 1.

The system comprises at least two microphones 111, 112 arranged close to each other. The close arrangement means that the signal received by each of the microphones 111, 112 has substantially the same RMS (root mean square) value, within a particular monitoring frequency range. In other words, when the microphones 111, 112 are placed within an acoustic field to be monitored, the RMS signal level of the acoustic field at each of the microphones is substantially the same. The particular arrangement of the microphones 111, 112 within the housing and distance with respect to each other depends on the particular design of the system and can be verified and adjusted experimentally.

The monitoring frequency range is the range (or a particular frequency) within which the system is supposed to be checked for correctness of operation. For example, outdoor microphone systems for ambient noise monitoring may have a monitoring frequency of 1 kHz or a monitoring frequency range from 20 Hz to 10 kHz.

Preferably, the microphones 111, 112 are MEMS microphones.

The microphones 111, 112 are physically arranged close with respect to each other, such as to receive a signal having substantially the same RMS value, i.e. such that the RMS value of a signal measured by one microphone does not differ from the RMS value of the signals measured by other microphones more than an allowable threshold.

The threshold shall not exceed the acceptable limit (which triggers the alarm), such as 1 dB, or shall not exceed ½ of the acceptable limit, or shall not exceed 1/10 of the acceptable limit.

For example, in case MEMS microphones are used, due to their small size (being integrated circuits of a size of a few millimeters), a plurality of microphones can be located on a common PCB (printed circuit board) within the distance of most preferably 6 mm (or less) from each other. Preferably, the microphones are arranged within an area of a circle of 1 inch diameter, or ¾ inch diameter, or ½ inch diameter. The microphones are arranged preferably on a common printed circuit board (in that case they are coplanar), but they may also be arranged on separate printed circuit boards, which need not be coplanar.

The outputs of the microphones 111, 112 are connected to a multi-channel analog/digital converter 121, each microphone output connected to a separate channel input of the A/D converter 121. The A/D converter outputs, for each channel, a digital signal corresponding to the signal measured by a particular microphone connected to that channel.

The A/D converter 121 is connected to a signal processing circuit 130, such as a DSP 130 (digital signal processor). The following modules can be implemented as functional modules of the DSP.

A measurement signal processing module 133 is configured to receive the outputs of the multi-channel A/D converter 121 and provide a measurement output signal, corresponding to the sum of signals measured by the measurement microphones, being the typical functionality of the noise measuring system.

Summing of the signals from all measurement channels (microphones) additionally improves signal-to-noise ratio as compared to single microphone measurements (because of uncorrelated self-noise of particular microphones and measurement of a correlated signal). For example, the S/N ratio can be 3 dB for two microphones, 5 dB for three microphones, 6 dB for four microphones etc.

The measurement result can be output by an output interface 140, for example a remote communication controller configured to transmit signals via a wired or wireless network to a system operator. The output interface 140 may comprise a dedicated measurement output indicator 141, such as a display, configured to visually indicate the current measurement results.

A microphones sensitivity register 131 is provided for storing reference data obtained for a calibration signal for each of the microphones.

A system check signal processing module 132 is configured to compare the current microphones signal output (RMS values) from the multichannel A/D converter 121 with the reference data stored in the register 131 and to determine whether a difference of the microphones sensitivity and/or frequency response stay within acceptable limits. If a difference above limit is identified, a system fault (alarm) signal is generated.

The fault signal can be output by the output interface 140, which may further comprise a dedicated fault signal indicator 142, such as a light emitting diode, configured to visually emit the fault signal.

Figure 2:
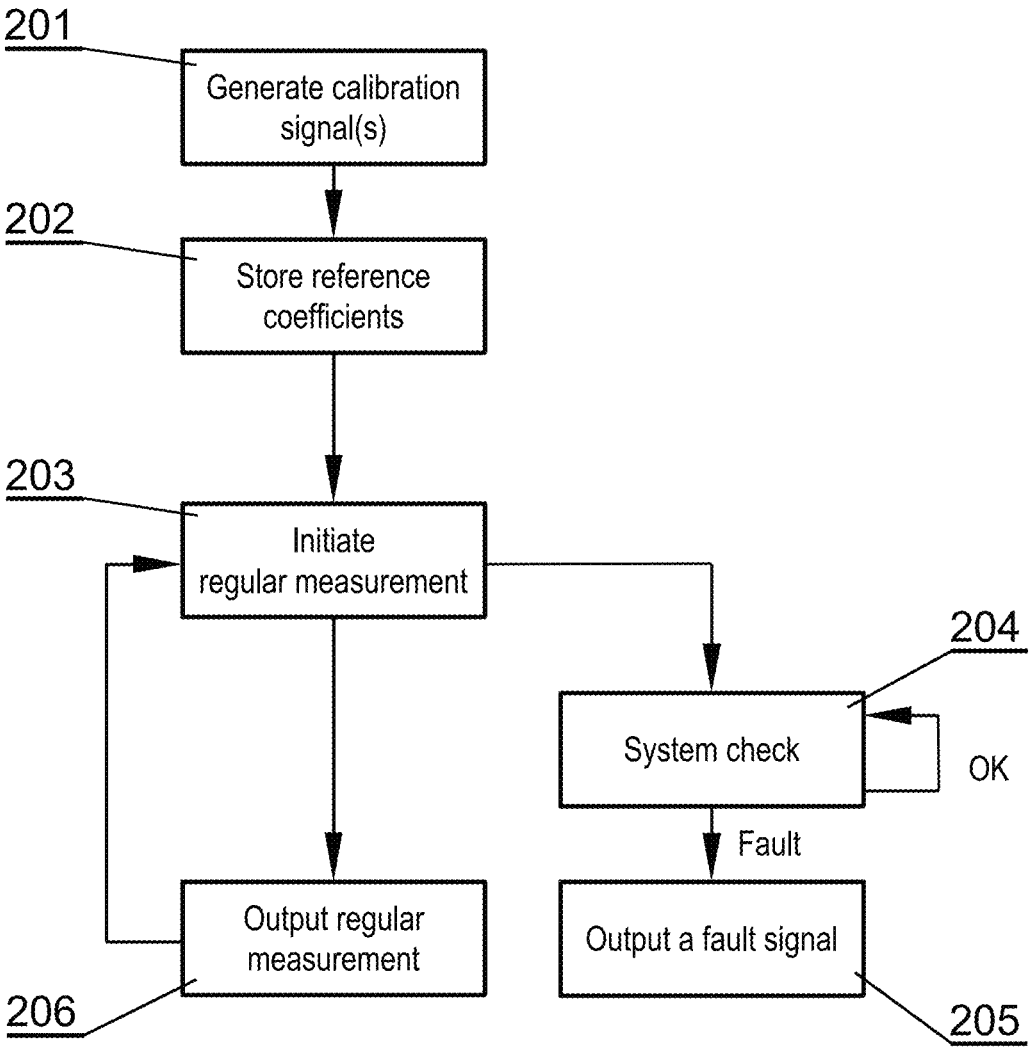
FIG. 2 shows a flowchart of a method for dynamic system checking.

The system can be operated according to the method shown in FIG. 2. First, system calibration is initiated by generating a common calibration signal in step 201 for reception by all the microphones 111, 112. For example, a tone calibrator can be used to generate a signal of a specific frequency or a sequence of signals for a plurality of frequencies within the measurement range of the system. Alternatively, or in addition, a wideband signal generator can be used to generate a wideband signal within the measurement range of the system. Therefore, one or more calibration procedures can be performed for specific signals.

In step 202, microphone sensitivity characteristics are determined for each of the microphones 111, 112 and microphone sensitivity data are stored in the microphones sensitivity register. The sensitivity characteristic should be determined for each microphone. The sensitivity characteristic can be determined for a specific frequency (such as 1000 Hz) or an individual characteristics can be determined for a plurality of frequencies. Moreover, if a wideband calibration signal is used, the sensitivity characteristics can be determined for "A" weighted, "C" weighted or 1/1 octave and/or ⅓ octave bands.

When calibrating the microphones in step 202, it may turn out that each microphone has a slightly different characteristic. The aim of this step is to store the original characteristics of the microphones in the microphones sensitivity register 131 for each of the microphones, in order to make it possible, during further operation of the system, to check whether the characteristic of one microphone has diverged from the characteristics of other microphone to an extent which would indicate that the microphone does not operate correctly any more.

For example, the microphones sensitivity register 131 can have a form of tables storing microphone measurement output values corresponding to input signal of a particular level and frequency.

In addition, difference tables may be generated in the register 131, that indicate what is the difference $\Delta_0$ between the output of one microphone with respect to the output of another microphone for a particular calibration signal level and frequency.

Once the reference data are determined for the calibration signal and stored in the microphones sensitivity register 131, the system can be switched to regular measurement mode.

During the regular measurement in step 203, a check can be initiated in step 204 to compare, by the system check signal processing module 132, the current microphone signals from the A/D converter 121 with the reference data stored in the register 131.

During the system check 203, current differences between RMS values of signals of all microphones are compared with the calibration data stored in the register 131. If these differences are within an accuracy threshold, the system continues normal operation. If not, a system fault signal is generated and output, via the system fault interface 142, in step 205. Typical accuracy threshold could be 1 to 2 dB.

Figure 3A:
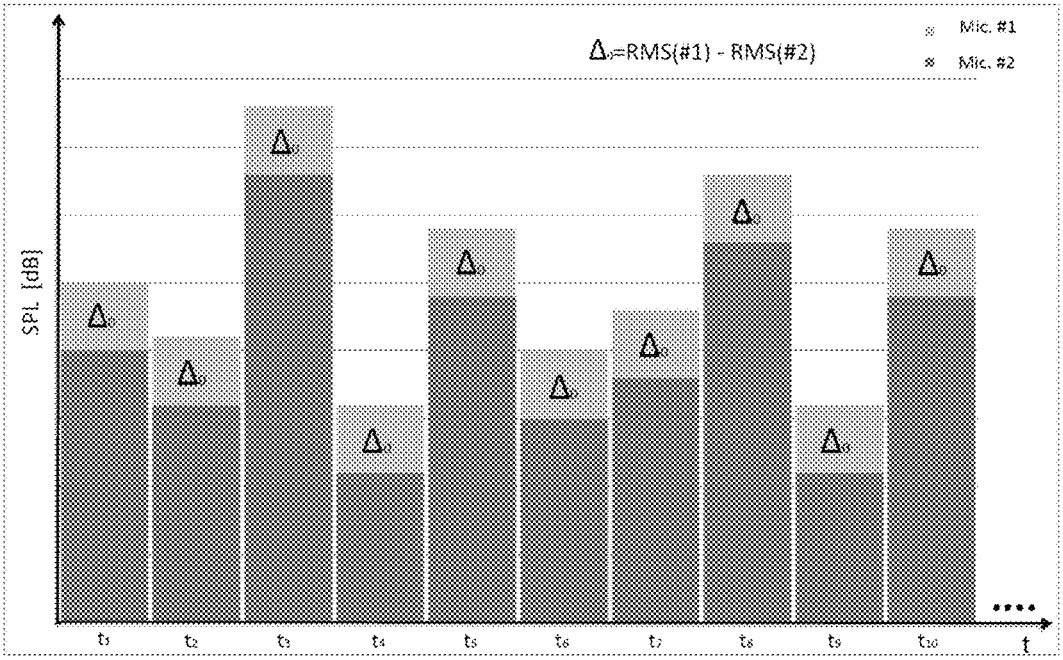
FIGS. 3A-3C show examples of measurement results of the microphone system of FIG. 1 taken at various stages of the method of FIG. 2.

FIG. 3A shows an example of measurement results for a correctly operating system, performed shortly after the calibration procedure. The plots correspond to the broadband response of the Mic#1 and Mic#2. $\Delta_0$ describes the initial sensitivity difference between Mic#1 and Mic#2 stored in register 131.

As the system operates in field, the characteristics of microphones may gradually degrade.

Figures 3B, 3C:
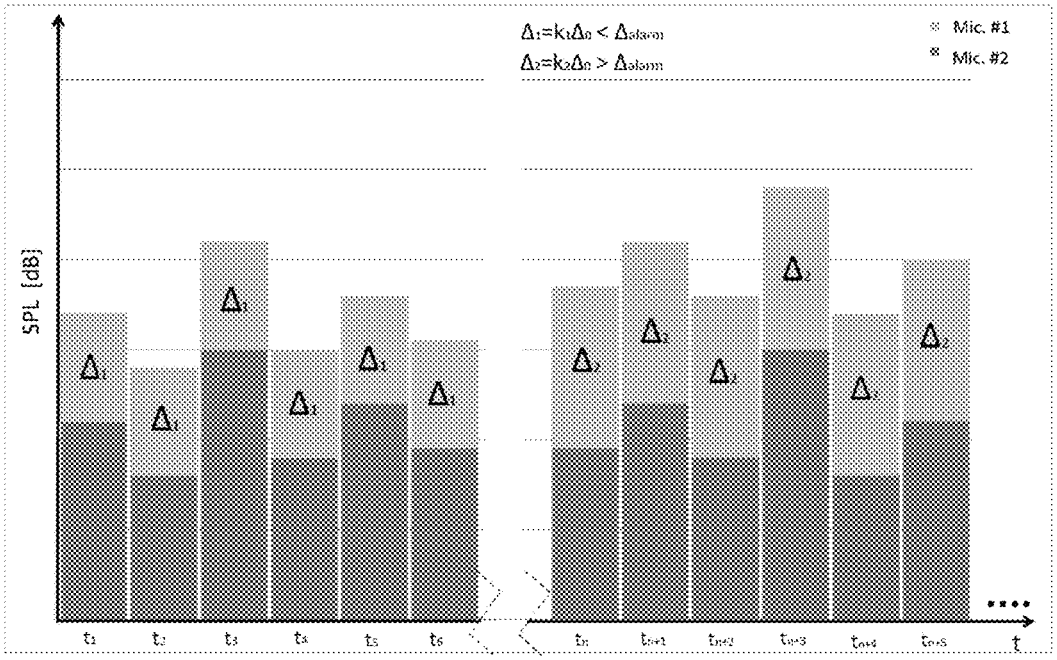

FIG. 3B shows an example of measurement results for a correctly operating system, wherein the microphone characteristics have degraded, i.e. the sensitivity difference $\Delta_1$ is higher than the initial sensitivity difference, but still within acceptable limit. $\Delta_1$ describes the current sensitivity difference between Mic#1 and Mic#2 detected during measurements, which is smaller then the acceptable limit, defined for example as a fraction k1 of the values of $\Delta_1$ and $\Delta_0$.

FIG. 3C shows an example of measurement results for an incorrectly operating system, wherein the microphone characteristics have degraded over an acceptable limit. 42 describes the current sensitivity difference between Mic#1 and Mic#2 detected during measurements, which is greater then the acceptable limit. In that case, the alarm signal is generated. For example, the alarm signal can be generated if the current difference exceeds the initial sensitivity difference by a predetermined threshold, such as 1 dB.

The checking procedure can be performed continuously or periodically in desired time intervals. The operation of the signal processor 130 does not disrupt the output of the regular measurement results in step 206 by the measurement output module 141, therefore it does not disrupt the regular measurement operation of the system.

The system is only prone to a situation wherein all microphones would fail in the same manner, such that they would provide the same incorrect results—but the probability of such situation is very unlikely.

Moreover, the system allows to compare not only the RMS value of the signal in the whole measured band, but RMS values of signal in selected frequency bands, i.e. to check variations of the frequency characteristics. This can be done by a DSP processor configured to perform octave analysis for all measurement channels.

The invention claimed is:

1. A method for checking of a microphone condition in a noise monitoring system that includes at least two microphones arranged physically with respect to each other such that when the microphones are placed within an acoustic field to be monitored, the root mean square (RMS) signal level of that acoustic field at each of the microphones is substantially the same for a monitoring frequency range, and a microphones sensitivity register that includes reference data indicative of an initial sensitivity difference (AO) between output RMS signal levels measured by the microphones in a reference acoustic field, the method comprising:

comparing a current difference (Δ1, Δ2) between the RMS signal levels concurrently output by the microphones for the currently monitored acoustic field and generating a fault signal if the current difference (Δ1, Δ2) differs from the initial sensitivity difference (Δ0) more than an acceptable limit, wherein the differences (Δ0, Δ1, Δ2) between the RMS signal levels are analyzed for a wide band signal.

2. The method according to claim 1, wherein two RMS signal levels are substantially the same if the difference between the RMS signal levels is lower than the acceptable limit that triggers the fault signal.

3. The method according to claim 1, wherein the acceptable limit is defined as a ratio of the current difference (Δ1, Δ2) and the initial sensitivity difference (Δ0).

4. The method according to claim 1, wherein the acceptable limit is defined as a difference between the current difference (Δ1, Δ2) and the initial sensitivity difference (Δ0).

5. A method for checking of a microphone condition in a noise monitoring system that includes at least two microphones arranged physically with respect to each other such that when the microphones are placed within an acoustic field to be monitored, the root mean square (RMS) signal level of that acoustic field at each of the microphones is substantially the same for a monitoring frequency range, and a microphones sensitivity register that includes reference data indicative of an initial sensitivity difference (Δ0) between output RMS signal levels measured by the microphones in a reference acoustic field, the method comprising:

comparing a current difference (Δ1, Δ2) between the RMS signal levels concurrently output by the microphones for the currently monitored acoustic field and generating a fault signal if the current difference (Δ1, Δ2) differs from the initial sensitivity difference (Δ0) more than an acceptable limit, wherein the differences (Δ0, Δ1, Δ2) between the RMS signal levels are analyzed individually for a plurality of narrow band signals.

6. The method according to claim 5, wherein two RMS signal levels are substantially the same if the difference between the RMS signal levels is lower than the acceptable limit that triggers the fault signal.

7. The method according to claim 5, wherein the acceptable limit is defined as a ratio of the current difference (Δ1, Δ2) and the initial sensitivity difference (Δ0).

8. The method according to claim 5, wherein the acceptable limit is defined as a difference between the current difference (Δ1, Δ2) and the initial sensitivity difference (Δ0).

* * * * *